US007637265B2

(12) United States Patent
Funatsu et al.

(10) Patent No.: US 7,637,265 B2
(45) Date of Patent: Dec. 29, 2009

(54) EYELASH TREATING DEVICE

(75) Inventors: Keiko Funatsu, Hikone (JP); Kenji Kamada, Hikone (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 350 days.

(21) Appl. No.: 11/660,217

(22) PCT Filed: Nov. 29, 2004

(86) PCT No.: PCT/JP2004/018092

§ 371 (c)(1),
(2), (4) Date: Feb. 15, 2007

(87) PCT Pub. No.: WO2006/057072

PCT Pub. Date: Jun. 1, 2006

(65) Prior Publication Data

US 2008/0035165 A1 Feb. 14, 2008

(51) Int. Cl.
*A45D 40/26* (2006.01)
*A45D 2/48* (2006.01)

(52) U.S. Cl. ..... 132/218; 132/217

(58) Field of Classification Search ..... 132/217, 132/218, 317; 401/1

See application file for complete search history.

(56) References Cited

U.S. PATENT DOCUMENTS 2,630,516 A 3/1953 Rausch et al.
5,007,442 A * 4/1991 Hirzel ..... 132/218
5,775,344 A * 7/1998 Clay ..... 132/218
5,853,010 A 12/1998 Suh
6,009,884 A 1/2000 Suh (Continued)

FOREIGN PATENT DOCUMENTS

EP 0 848 920 A1 6/1998

(Continued)

OTHER PUBLICATIONS

Written Opinion of the International Search Authority for PCT/JP2004/018092 filed Nov. 29, 2004.

*Primary Examiner*—Robyn Doan
(74) *Attorney, Agent, or Firm*—Edwards Angell Palmer & Dodge LLP

(57) ABSTRACT

An eyelash treatment device including an applicator equipped with a heater for softening a mascara composition which is solid at a room temperature. The applicator includes, in addition to a comb arranged along the length of the applicator, a heat radiator which is exposed on the applicator and is configured to have a continuous heating strip extending along the length of the applicator to receive the solid mascara composition for softening the composition by heat. Also, the heat radiator is configured to have a trough for holding the softened mascara composition. The comb projects from within the trough for delivering the softened mascara composition to the eyelashes when smoothening the eyelashes. Because the heating strip extends continuously along the length of the heat radiator without being interrupted by any member, the mascara composition can be loaded over the full length of the heating strip so as to be applied successfully and uniformly to the eyelashes from the applicator. Thus, the softened mascara composition can be successfully delivered to the eyelashes from the entire length of the comb or the applicator, leaving the solid mascara film on the eyelashes by being cooled.

6 Claims, 3 Drawing Sheets

U.S. PATENT DOCUMENTS

| | | | | |
|---|---|---|---|---|
| 7,090,420 | B2 * | 8/2006 | De La Poterie et al. | 401/1 |
| 2005/0058496 | A1 | 3/2005 | De La Poterie et al. | |

FOREIGN PATENT DOCUMENTS

| | | | |
|---|---|---|---|
| EP | 1 466 541 | A1 | 10/2004 |
| JP | 2003-310335 | | 11/2003 |
| WO | WO 99/22782 | | 5/1999 |

* cited by examiner

EYELASH TREATING DEVICE

BACKGROUND OF THE INVENTION

1. Field of the Invention

The present invention relates to an eyelash treating device for applying the mascara composition to a user's eyelashes, and more particularly to such device designed for use of a solid mascara composition.

2. Description of the Related Art

There have been proposed in the art eyelash treating devices, such as WO 99/22782 including a applicator brush and heater combination. The applicator brush is designed to curl the eyelashes by application of heat, while applying the mascara composition of liquid or semi-liquid condition fetched from a container. However, due to the absence of the idea and structure for heating and softening the solid mascara composition which is solid at a room temperature, the applicator brush is practically impossible to use in combination with the solid mascara composition. In view of the problem, there is a need of providing a dedicated heating device which takes the full benefit of the solid mascara composition to apply the softened mascara composition successfully and uniformly to the eyelashes.

SUMMARY OF THE INVENTION

The device of the present invention is specifically designed to provide a structure that is configured to soften the mascara composition and to hold the softened mascara composition for applying it to the eyelashes uniformly. The device includes an applicator equipped with a heater for softening the mascara composition, and a comb arranged along the length of the applicator. The applicator includes a heat radiator which is exposed on the applicator and is held in a thermally conducting relation with the heater. The heat radiator is configured to have a continuous heating strip extending along the length of the applicator to receive the solid mascara composition for softening the composition by heat. Also, the heat radiator is configured to have a trough for holding the softened mascara composition. The comb projects from within the trough for delivering the softened mascara composition to the eyelashes when smoothening the eyelashes. Since the heating strip extends continuously along the length of the heat radiator without being interrupted by any member, the mascara composition can be loaded over the full length of the heating strip so as to be applied successfully and uniformly to the eyelashes from the applicator. Thus, the softened mascara composition can be successfully delivered to the eyelashes from the entire length of the comb or the applicator, leaving the solid mascara film on the eyelashes by being cooled.

Preferably, the heat radiator is shaped to give two rows of the heating strip which are spaced widthwise of the applicator to define therebetween the trough. Thus, the softened mascara composition at either one of the rows can be collected in the trough for wetting the comb. In this connection, the heating strip is inclined down to the trough for smooth flow of the softened mascara composition to the trough.

The applicator may include a side comb disposed on opposite sides of the applicator and arranged along the rows of the heating strip, respectively. The side comb covers a portion of the heating strip to leave the other portion exposed continuously over the length of the applicator. The side comb gives an additional smoothening effect for providing a stylish mascara treatment.

Further, the heat radiator is preferably formed from a single metal sheet and is bent to have a generally U-shaped section each composed of a rounded top defining the heating strip and legs depending from opposite sides of said rounded top. The U-shaped section provides between the legs a space for accommodating therein the heater in contact with said rounded top. Thus, the heater and the heating radiator can be made into a low-profile structure for compactness of the applicator.

These and still other advantageous features of the present invention will become more apparent from the following description of the preferred embodiment when taken in conjunction with the attached drawings.

DETAILED DESCRIPTION OF AN EXEMPLARY EMBODIMENT

Now referring to FIGS. 1 to 4, there is shown an eyelash treatment device in accordance with a preferred embodiment of the present invention. The device uses a solid mascara composition which is prepared in the form of a viscous body to be solid at room temperature, namely 25° C., and is softened with elevated temperature such that it can be applied to the eyelashes. By "solid" herein for describing the mascara composition, what is meant is that the composition has a certain hardness to retain its structure, and also that the composition is stable against stress or shear. The mascara composition goes through a transition change in terms of rheology between 25° C. and 100° C., such that during these temperatures, there is a range of temperature and rheology in which the composition is suitably softened for application to the eyelashes. The softened state of the mascara composition is fluid enough to be applied to the eyelashes, however, is viscous enough to stay on the applicator upon application, and on the eyelashes after application The device includes an elongated hand grip 10 carrying at its one longitudinal end an applicator 20 for applying the softened mascara composition to user's eyelashes.

The applicator 20 is elongated to have a length generally aligned with a length of the grip 10, and includes a heat radiator 40 and a center comb 30 configured to smoothen the eyelashes. The heat radiator 40 is provided to heat the mascara composition for softening the composition after it is loaded to the applicator 20 on one hand, and to heat the eyelashes for curling on the other hand. The heat radiator 40 as well as the comb 30 are both arranged to extend over the substantially the full length of the applicator 20.

Figure 1:
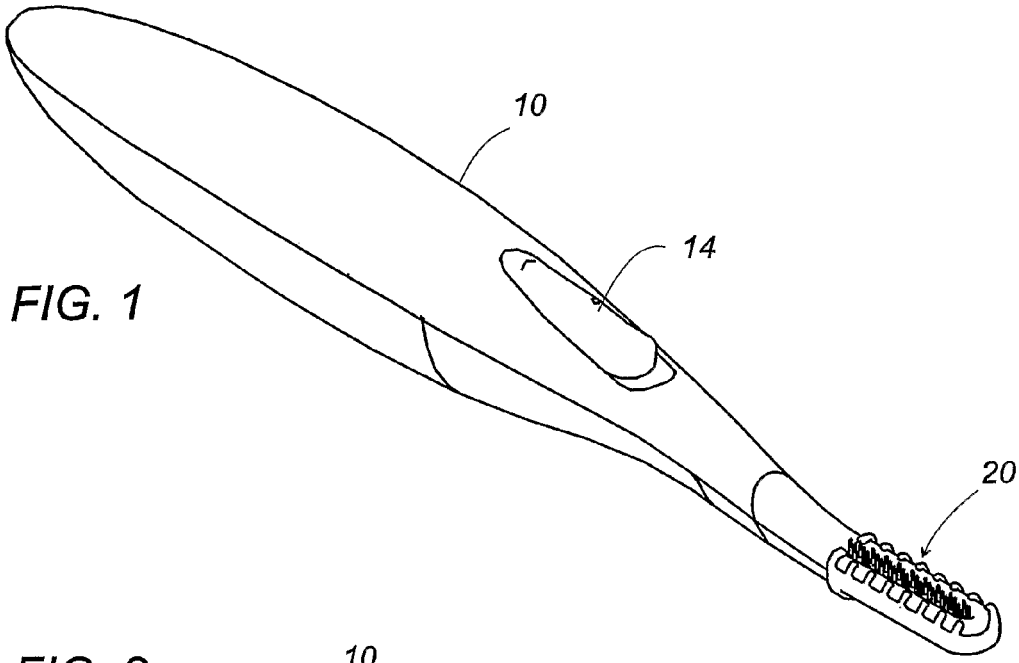
FIG. 1 is a perspective view of an eyelash treatment device in accordance with a preferred embodiment of the present invention.
Figure 2:
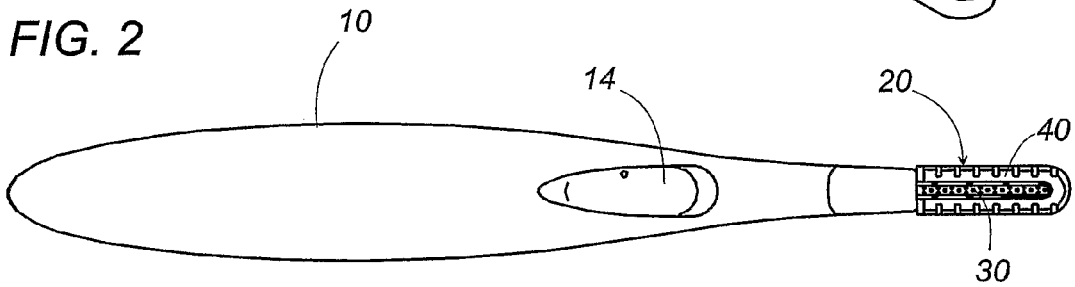
FIG. 2 is a top view of the eyelash treatment device.
Figure 3:
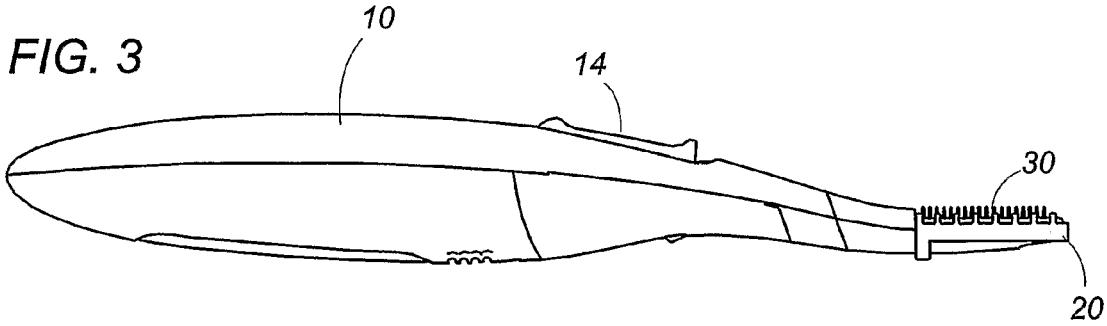
FIG. 3 is front view of the device.
Figure 4:
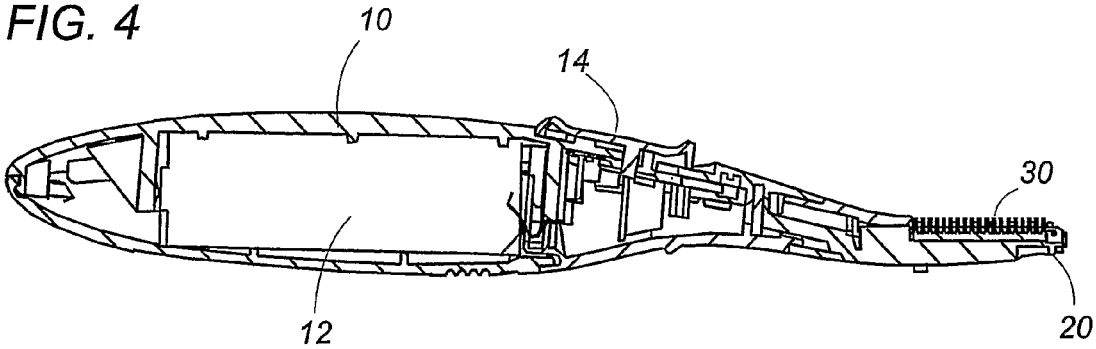
FIG. 4 is a sectional view of the device.
Figure 5:
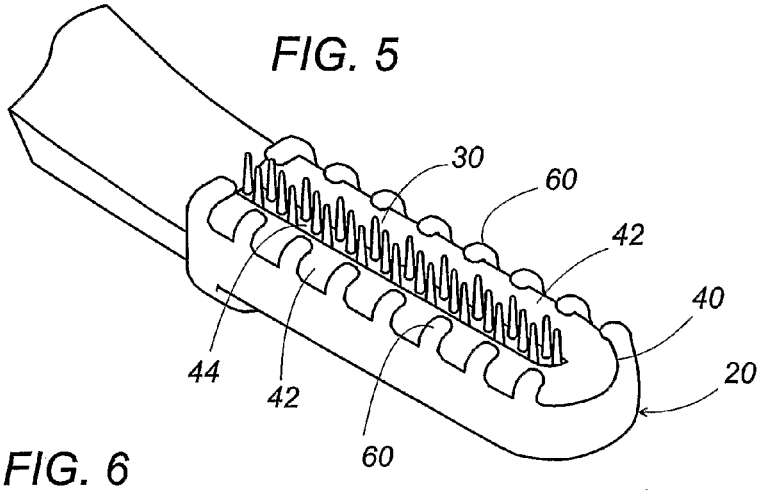
FIG. 5 is a perspective view of an applicator utilized in the device.
Figure 6:
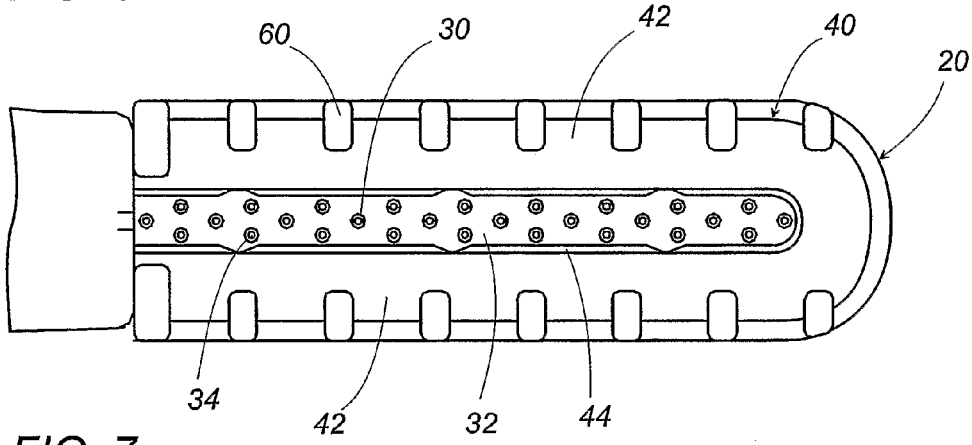
FIG. 6 is a top view of the applicator.
Figure 7:
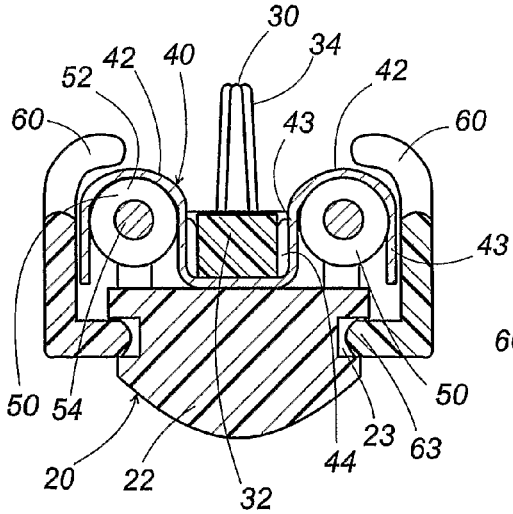
FIG. 7 is a sectional view of the applicator.

As shown in FIG. 7, the applicator 20 has a base 22 made of a dielectric plastic material that carries an electric heater 50 as a heat source for the heat radiator 40, in addition to the center comb 30 and the heat radiator 40. The electric heater 50 is composed of a resister coil 52 wound around a U-shaped core 54 of dielectric material to give two parallel rows running in the length of the applicator 20. The coil 52 is electrically connected to a voltage source, i.e., a battery 12 accommodated within the grip 10 through a switch so as to be energized by manipulating a switch handle 14 on the side of the grip 10.

Figure 8:
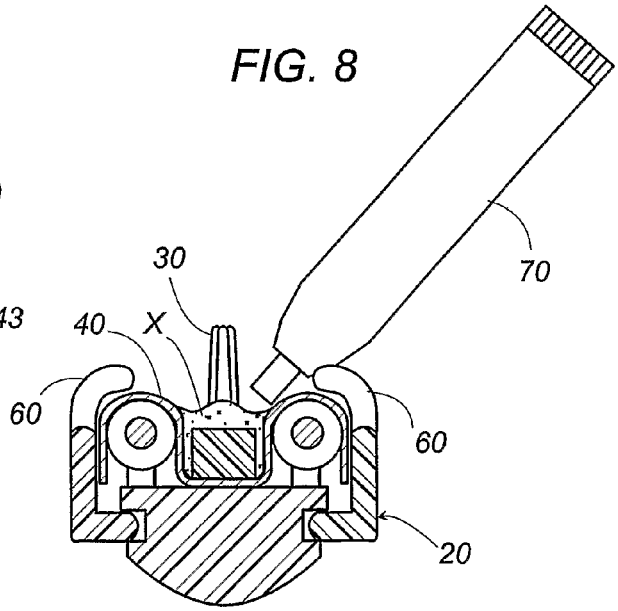
FIG. 8 is a sectional view of the applicator illustrating how a mascara composition is loaded to the applicator.

The heat radiator 40 is shaped from a single metal sheet, for example, a stainless steel to have two parallel rows of heating strip 42 which are joined at the tip of the applicator 20, forming a U-shaped horizontal configuration in match with the heater 50. The rows of the heating string 42 are exposed on the surface of the applicator 20 to extend along the length of the applicator 20 so as to be capable of being held in direct contact with the eyelashes for curling the eyelashes. Also, the rows of the continuous heating strip 42 define a loading site where the solid mascara composition is loaded on the heat radiator 40. Thus, the mascara composition can be supplied along the entire length of the heating strip 42, i.e., the applicator 20, for example, by squeezing it out of a tube 70 containing the solid mascara composition while moving a point of supply along the length of the applicator 20, as shown in FIG. 8. Alternatively, the solid mascara composition may be prepared in the form of a stick dimensioned to extend the length of the heating strip 42. Since the heating strip 42 extends continuously over the length of the applicator 20, the mascara composition can be supplied over the entire length of the applicator 20, irrespective of the manner of loading the mascara composition.

The rows of the heating strip 52 are spaced in a width direction of the applicator 20 to define therebetween a trough 44 which runs over the length of the applicator 20 for holding the softened mascara composition X, as shown in FIG. 8. In detail, the metal sheet is bent to form a U-shaped vertical section, as shown in FIG. 7, composed of a rounded top defining the heating strip 42 and legs 43 depending from opposite sides of the rounded top. It is within a space left between the legs of the U-shaped vertical section that the electric heater 50 is received in contact with or in closely adjacent relation to the heat radiator 40 for thermal conduction to the heating strip 42 and the trough 44. Thus, the whole applicator 20 can be made into a low-profile structure, yet providing a large heating capacity. The heat radiator 40 thus configured is assembled to the base 22 with the bottom of the trough 44 seated on top of the base 22. The center comb 30 is held at the width center of the applicator 20 with its root 32 received within the bottom of the trough 44 in such a manner as to project comb teeth 34 above the heating strip 42. It is noted that the root 32 does not interfere the continuity of the trough 44 along its length so that the softened mascara composition X is held over the length of the trough 44. Thus, once the mascara composition is supplied over the length of the heating strip 42 and is heated thereat, the softened composition can spread into the trough 44, thereby wetting the root of the center comb 30. With this result, the softened composition is allowed to climb-up to the comb 30 by the action of a surface tension to be ready for being delivered to the eyelashes as the comb 30 smoothens the eyelashes. For smooth flow of the softened composition into the trough 44, the heating strip 42 is inclined or rounded down to the trough 44. Some of the softened composition remains on the heating strip 42 to be delivered directly to the eyelashes when the eyelashes come into contact with the heating strip 42.

Also included in the applicator 20 are arrays of side comb 60 arranged along the opposite width ends of the applicator 20 in a closely adjacent relation to the rows of the heating strip 42. The side comb 60 is integrated in one unit which is secured to the base 22 by engagement of hooks 63 into side grooves 23 of the base 22. The side comb 60 has its top end bent over a portion of the adjacent heating strip 42 for smoothing the eyelashes in combination with the center comb 30. The root of the side comb 60 shields the opposite sides of the heat radiator 40 against the contact with the user's face around the eyes.

Figure 9:
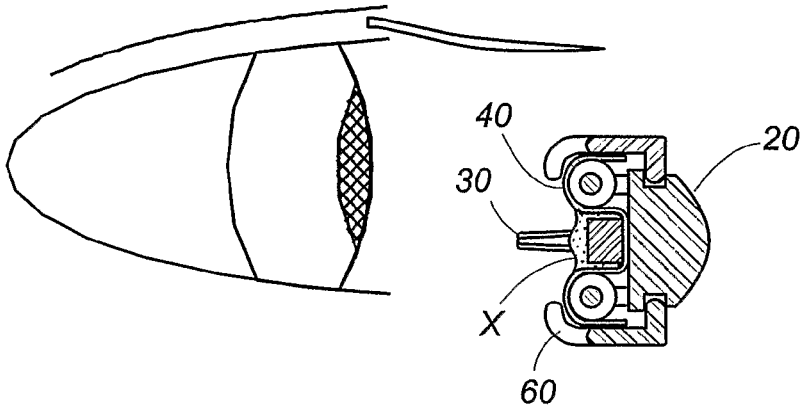
FIGS. 9 to 11 are views explaining how to apply the mascara composition while curing the eyelashes with the use of the device.
Figure 10:
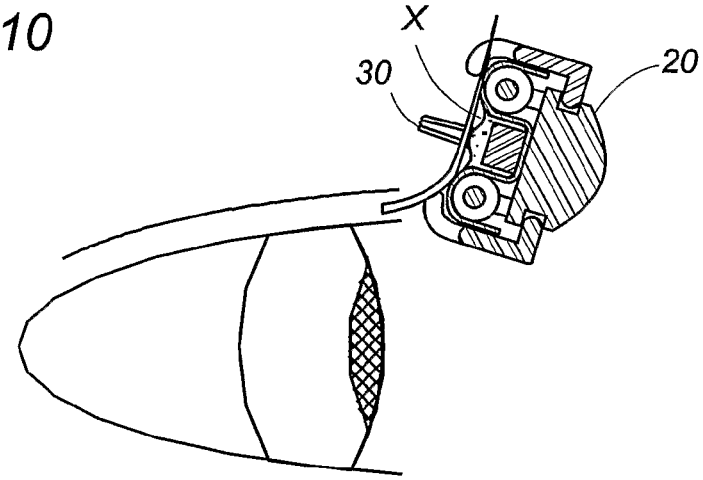
Figure 11:
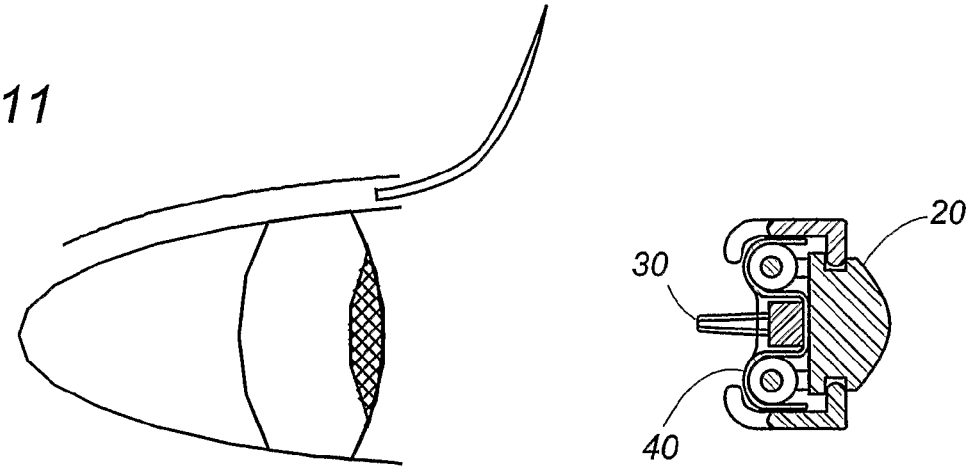

In operation, the applicator 20 is firstly placed in a position with the comb 30 just below the eyelashes, as shown in FIG. 9. Then, the applicator 20 is raised and twisted to some extent for smoothing the eyelashes with the center comb 30 carrying the softened mascara composition, as shown in FIG. 10, thereby applying the fluidizing mascara composition to the eyelashes, while lifting the eyelashes. In this condition, the heating strip 42 comes into contact with the eyelashes for heating and curling the eyelashes. As soon as the applicator 20 is moved away from the eyelashes, as shown in FIG. 11, the softened mascara composition is cooled quickly to give a firm film of the solidified mascara composition on the eyelashes. Thus, the above single operation can give the effect of forming the mascara film as well as curling the eyelashes. When the eyelashes are first coming into contact with the heating strip 42, the side comb 60 smoothes the eyelashes in advance of the center comb 30 to ensure uniform application of the mascara composition to the previously smoothed eyelashes. Also when the eyelashes are leaving from the heating strip 42, the side comb 60 comes to again smooth the wetted eyelashes for assuring a stylish mascara treated finish.

The heater 50 is controlled to heat the heating strip 42 to a temperature of about 50° C. to 100° C. for softening the mascara composition. At the elevated temperature, the softened mascara composition exhibits a viscosity of 1 mPas to 10,000,000 mPas, sufficient for coating the eyelashes, but being kept from flowing out of the applicator 20 for assuring a safe application of the mascara composition.

The invention claimed is:

1. An eyelash treatment device comprising:

a grip (10) to be grasped by a user's hand; and an applicator (20) adapted to be supported by said grip and to receive a mascara composition for delivering said mascara composition to eyelashes of the user, said applicator being elongated to have a length and including:

a heater (50) included in said applicator for heating said applicator; and a comb (30) arranged along the length of said applicator, wherein said applicator includes a heat radiator (40) exposed on said applicator, said heat radiator being held in a thermally conducting relation with said heater and configured to have a continuous heating strip (42) that extends along the length of said applicator to receive said mascara composition for softening said composition, said heat radiator including a trough (44) for holding said softening mascara composition, and said comb projecting from within said trough for delivering said softened mascara composition to the eyelashes when smoothening the eyelashes.

2. The eyelash treatment device as set forth in claim 1, wherein said heat radiator is shaped to provide two rows of said heating strip which are spaced widthwise of said applicator to define therebetween said trough.

3. The eyelash treatment device as set forth in claim 1, wherein said trough extends continuously along the length of said heating strip.

4. The eyelash treatment device as set forth in claim 2, wherein said heating strip is inclined downward toward said trough.

5. The eyelash treatment device as set forth in claim 2, wherein said applicator includes a side comb (60) disposed on opposite sides of said applicator and arranged along the rows of said heating strip, said side comb covering a portion of the heating strip to leave the other portion exposed continuously over the length of said applicator.

6. The eyelash treatment device as set forth in claim 2, wherein said heat radiator is formed from a single metal sheet and is bent to have a generally U-shaped section each composed of a rounded top defining said heating strip and legs depending from opposite sides of said rounded top, said U-shaped section defining between said legs a space for accommodating therein said heater in contact with said rounded top.

* * * * *